US006150937A

United States Patent [19]

Rackman

[11] Patent Number: 6,150,937

[45] Date of Patent: Nov. 21, 2000

[54] PERSONAL CONTACT "ICE BREAKER"

[76] Inventor: Michael I. Rackman, 1710 Glenwood Rd., Brooklyn, N.Y. 11230

[21] Appl. No.: 09/329,283

[22] Filed: Jun. 16, 1999

Related U.S. Application Data

[60] Provisional application No. 60/091,027, Jun. 29, 1998.

[51] Int. Cl.[7] ..... G08B 1/08

[52] U.S. Cl. ..... 340/539; 340/505; 340/567; 340/825.3; 340/825.44; 340/825.46; 340/825.47; 709/253

[58] Field of Search ..... 340/539, 573.1, 340/825.3, 825.44, 825.46, 825.47, 505, 567, 146.2; 709/253

[56] References Cited

U.S. PATENT DOCUMENTS 4,348,744 9/1982 White ..... 340/825.3 X

*Primary Examiner*—Daryl Pope

*Attorney, Agent, or Firm*—Gottlieb, Backman & Reisman, P.C.

[57] ABSTRACT

A set of badges is distributed at a party to help attending party-goers "break the ice" with members of the opposite sex. Each girl at the party is given a badge of one type, and each boy is given a badge of another type. Each badge has a light that can blink, but it is normally off. Each badge transmits a contact signal that is picked up by any opposite-type badge that is in proximity with it. If the two badges blink, indicating a match, the facing boy and girl must start talking to each other. Either both badges will blink or neither will, but whether or not they blink is based on chance. Each party-goer is given a hidden remote control which, when turned on, increases the probability of the lights blinking. Provision is also made for an exchange of personal information via the badges when a match is made.

22 Claims, 3 Drawing Sheets

PERSONAL CONTACT "ICE BREAKER"

This application claims the benefit of U.S. provisional application No. 60/091,027 filed on Jun. 29, 1998. The invention relates to making personal contacts, for example, between persons of opposite sexes who may be too shy to start a conversation with each other, and more particularly to a system and method for facilitating such contacts.

There are several products that have been proposed for facilitating the making of contact between people. It has been reported, for example, that Playmate Toys is marketing keychain toys that can send E-mail style messages to each other. A child can also enter personal information such as his sex, age and hobbies. When one device comes within range of another unit programmed with similar interests, the devices ring, alerting their owners. Philips has also developed a concept known as a Hit Badge—a wearer's personal information is stored and passed on wirelessly to others with similar interests to help people "break the ice."

Anyone who has chaperoned a party of teenagers knows that they especially have difficulty in starting up a conversation. It would be highly advantageous to have a mechanism that would promote contact. It would be especially helpful if a boy, for example, who wants to engage in conversation with a particular girl could have the ice broken, e.g., badges that they are wearing start blinking when they face each other, the party rule being that when facing badges blink the wearers must start talking to each other. However, if the "target" girl does not want to talk to that particular boy, she should not have to do so. One of the problems in this regard is how to avoid embarrassing one of two teenagers, one of whom wants to "meet" the other, when the other has no reciprocal desire.

It is a general object of my invention to facilitate the making of contact between members of the opposite sexes, without requiring contact between two persons one of whom does not want to meet, yet without allowing anyone to become embarrassed in the process.

Although the broader aspects of the invention will be discussed later, the easiest way to understand the invention is in the context of a party. A set of badges (or pins, pendants, etc.) is distributed at the party to help attending party-goers to "break the ice" with members of the opposite sex. Each girl at the party is given a badge of one type (e.g., of one color, with perhaps an advertising logo since someone has to support purchase or rental of the equipment), and each boy is given a badge of another type (e.g., of another color, with the same or a different logo). Each badge has a light that can blink, but it is normally off.

In addition to having a light that can blink, each girl-badge can transmit a "contact" signal (similar to the infrared signal of a TV remote control or even a short-range RF signal) that is picked up only by a boy-badge that faces it and is within a few feet (e.g., four feet) of the girl-badge. The girl wearing the badge has an RF remote control button (or other type of switch mechanism, e.g., a switch that is turned on and off simply by touching it) that she carries hidden somewhere in a pocket or other non-visible place on her person, or even in her hand. Her badge transmits its "contact" signal only when she turns it on with her remote "control" signal. (The two types of signal must be clearly delineated to understand the invention. The contact signal is transmitted by a girl-badge, for example, and communicates with a facing boy-badge. The control signal is operated by the girl wearing the girl-badge and communicates only with the respective girl-badge to control how it operates.)

Similarly, each boy-badge transmits a contact signal that is picked up by any girl-badge that faces it and is within range of the boy-badge, but the contact signal is transmitted only when the boy turns it on with his hidden remote control. All transmitters are normally left on and transmit continuously, but each has only a very short range.

If a boy and a girl facing each other both have their badge transmitters on, then both badges may (may, as opposed to always) start blinking their lights. (Although the discussion here is in terms of blinking lights, a less intrusive indication of a possible "compatible match" can be used, e.g., a miniature display that changes its image.) A badge may blink only if (a) its user has turned it on with his/her remote control device, and (b) the badge is receiving a contact transmission from a facing badge being worn by a person of the opposite sex. If both badges blink, the boy and girl must start talking to each other. (This compulsory-talk rule is the "ice-breaker.")

Two facing badges, both of which are transmitting, will not necessarily blink. Either both will blink or neither will, but whether or not they blink is based on chance. There is only a small probability that they will blink (and then only if both transmitters are on), but if they do blink it is an indication of a possible "compatible match," which is why the persons wearing the badges must talk to each other.

The chance aspect of the system is critical. If any boy or girl has his/her badge transmitter turned off, then neither badge can blink even if the facing badge has its transmitter turned on. Any person can prevent contact with another whom they definitely do not want to meet without embarrassing that other person—even if the "rejected" other person has his/her transmitter turned on (because he/she wants to meet the person of the opposite sex facing him/her), the odds are that the lights did not blink because the probability is high that they will not blink even if both transmitters are on. No one need feel that a match was not made because the other person did not want it.

The problem with this embarrassment-avoidance technique of basing a possible match on chance is that the lights will probably not blink even for two persons who do want to talk to each other (but need the "command" of the blinking lights to break the ice). The solution is to give each party-goer a second hidden remote control button (or touch-sensitive switch, etc.). This "probability-enhancement" or PE button, when turned on, increases the probability of both lights blinking (but still only if the facing badge has its transmitter turned on). Suppose boy/girl A has turned on his/her probability-enhancement button, and girl/boy B has not even turned on her/his transmitter. In this case, the lights do not blink, but A is not embarrassed (by wanting to meet B, while B did not want to meet A) because there is no guarantee that lights will blink even if both transmitters are working and even if both probability-enhancement buttons have been turned on. But if both transmitters are turned on, then there is a higher probability of blinking if at least one of the badges has its probability-enhancement button turned on, and there is a still higher probability of blinking if both PE buttons have been operated.

There are many enhancements to the basic system, and further objects, features and advantages of the invention will become apparent upon consideration of the following detailed description in conjunction with the drawing, in which.

Figure 1:
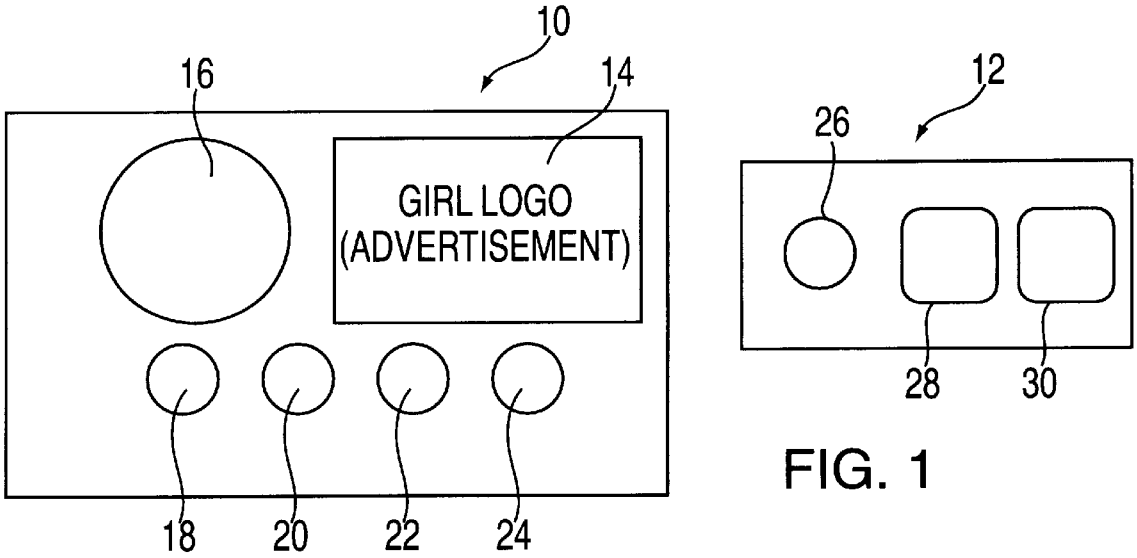
FIG. 1 depicts symbolically the form of a girl badge and its paired remote control device.
Figure 2:
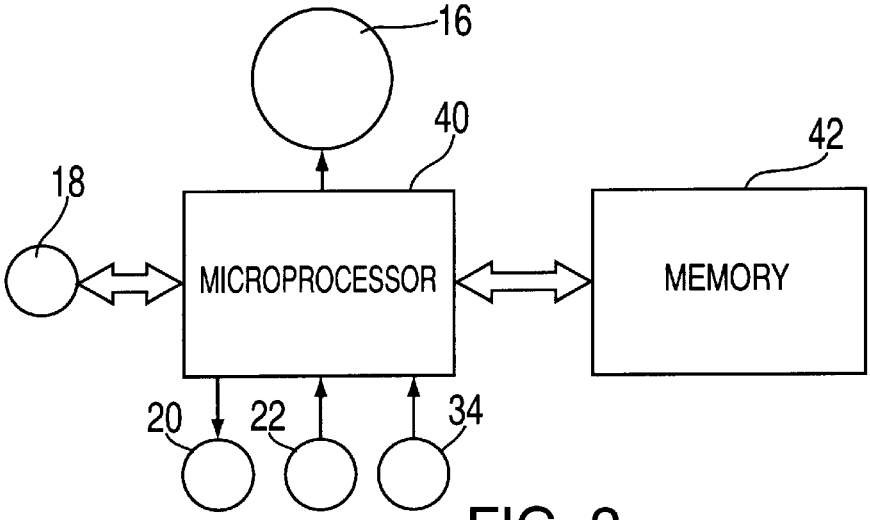
FIG. 2 is a block diagram of the components included in a badge.

The basic methodology can be understood from the following table which summarizes a typical set of blinking probabilities:

| | A: Transmitter off | A: Transmitter on Prob.-enh. off | A: Transmitter on Prob.-enh. on |
|---|---|---|---|
| B: Transmitter off | 0 | 0 | 0 |
| B: Transmitter on Prob.-enh. Off | 0 | 30% | 45% |
| B: Transmitter on Prob.-enh. On | 0 | 45% | 75% |

To understand the table, it must be borne in mind that either both facing badges blink, or neither does—the table shows the probability that both will blink. The five "zero" entries are for the cases where one or both transmitters are off—in such a case, since at least one of the party-goers is not interested in meeting anyone or he/she is at least not interested in meeting the facing person, there is no blinking. The 30% case is where both transmitters are on, but neither party actively wants to meet the other. The two 45% cases are where one person wants to talk to the other, but the other doesn't have a preference either way (his/her contact control button has been operated, but not his/her probability-enhancement button). An alternative design would change the 45% probabilities to 30%, under the logic that unless both parties want to meet each other, the probability of blinking should be kept at the minimum value. Only if both want to meet does the probability jump to the highest value, 75% in the example.

It should be appreciated why even if each person wants to meet the other, the probability is not made 100%. It is very important that no one be embarrassed by knowing that the facing person does not want to meet him/her. Were the blinking probability increased to 100% for the case where both persons operate their probability-enhancement controls and were one person to operate his/her probability-enhancement control and the badges did not blink, it would indicate that the other person did not operate her/his probability-enhancement control and perhaps did not even turn on her/his contact transmitter.

Every attendee at the party is given a badge, but because its transmitter can be turned off, the badge can effectively be "taken out of service." Therefore, non-blinking lights are not necessarily indications of "rejection" because it is possible that one of the persons facing each other is just not interested in meeting anyone and turned off his/her transmitter. Theoretically, this would allow the highest probability to be increased even up to 100% without causing embarrassment, but it would require a "difficult" assumption that the facing person is not interested in meeting anyone. Also, using lower probabilities is in general preferred because the apparent significance of a positive "match" is diminished if they occur too often.

There are many possible enhancements to the basic operation described thus far. These enhancements are not shown in the flow charts because how to implement them in software is straightforward once it is understood what the enhancements are. Preferably, before each badge is given out upon entry to the party, the intended wearer may key in to a badge "issuer" (a PC or laptop for writing data on a badge, or for writing data on a card that is inserted into the badge) personal information such as name, address, telephone number, hobbies, etc. (as much personal information as the user cares to give out to persons he/she may be "matched" up with during the course of the party), and this information may be temporarily stored in the badge for the duration of the party. Information stored in two facing, blinking badges may be automatically exchanged (via the contact transmission links), in a manner similar to the way two Palm Pilots or other PDA (personal digital assistant) devices do it. Upon leaving the party, as each person hands in his/her badge, a badge reader/printer (the same PC or laptop) may access the stored information and furnish to the user of the badge a printout of the information received from opposite-sex badges during the course of the party.

The ability to store information in a badge upon entry to the party also allows the matching process to be made more "scientific," i.e., less random than in the simple form of the invention described above. The information initially stored can include items such as religion, favorite sports, etc., and the information can be exchanged when badges first face each other. The probability of the lights blinking to indicate a "match" can be made higher as a function of the compatibility (e.g., same favorite sport) of the facing persons. (Since the decision whether to blink is made by the girl-badge, as will be described below, it is really only the boy-badge that must transmit its user's stored personal information over the contact transmission link in order to affect the probability of a match. However, for any boy-badge to have its accumulated information from multiple girl-badges printed out at the end of the party, girl-badges also have to transmit their stored personal information to boy-badges.) The chance factor, however, still must be at the heart of the matching process. Perhaps the only exception might be some category designated by one party to be so essential (e.g., religion) that if the preferences do not match a match is precluded. The initial information exchange is used only briefly and is then erased, it is not complete (for example, names are not necessary), and it is used solely—if at all—to affect the probability of a match. If a match is made, then complete information records can be exchanged automatically as described above.

Some of the information may be very personal (e.g., sexual), to the extent that the person typing it into the badge-issuing PC or laptop would not want it to be conveyed to any member of the opposite sex even though he/she might want it to be used in the matching-up process. The problem is not in transmitting information from one badge to the other over the contact tranmission link. The problem is in printing out the information at the end—that is the only time collected information in any badge (collected from multiple opposite-sex badges during the course of the party) may see the light of day. The solution is to have each person identify, at the time he/she types his/her personal information into the badge-issuing PC or laptop, those items of the information that should be used to affect match decisions but which should not be printed out. These items of information, even though they may be transferred over contact communication links, are stored in receiving badges with tags that tell the reader/printer PC that they should not be printed. (The PC, when it reads a badge at the end of a party and prints out accumulated information, then resets the badge to erase all keyed-in and collected information.) Thus while all information may be used in the matching process, secrecy is preserved for any selected items of information (even all items, including name, if desired).

The transmitter and probability-enhancement (PE) buttons are best hidden from view. Standard IR remote control units are preferably not used because they often require a line-of-sight to function. Weak RF transmitters should be sufficient in most cases. However, it is not really necessary to hide the two control buttons. Everyone at the party knows that everyone else has two control buttons that affect operation of the wearer's badge. The important thing is that the buttons be operated without an approaching or facing member of the opposite sex seeing them being operated or, if they are seen being operated, at least without knowledge of which are being turned on or off. (Touch-sensitive switches on the badges themselves can be used, but care must be taken not to let an approaching person see which switches are being touched.)

As described below in connection with actual implementation of the system, a decision on whether or not to blink (and possibly to exchange information if that enhancement is added to the basic system) is made within a few seconds of a face-to-face meeting. Once a decision is made, it is not changed for as long as the badges remain facing each other. Were decisions to be made repeatedly, since they are based on chance, eventually every encounter would result in a chance "match."

The system has been described thus far as it might be used at a party. But certain aspects have broader applications. For example, two groups of devices might be assigned to respective members of two different groups of persons who are not necessarily of opposite sexes. The devices might be worn all day long. Whenever two persons wearing the devices meet and are in proximity to each other, a decision that is at least partly random is made whether those two persons should make contact and both devices then provide the same indication (in the form of lights, sounds, a changed logo, etc.). (It is possible to have just one of the devices provide the indication of whether contact should be made, but it is preferred that both blink, both emit a beep, etc.) Information exchange may occur both before and after the decision is made as described above. In addition to the two buttons on the remote unit already described, there may be a third that allows selection of which type of facing device (e.g., opposite sex, same sex, or both) should even be considered for a possible match. Also, since this type of application is not in a controlled environment, a user might want to limit the information that he/she gives out. For this reason there may be still another button that selects whether all or only a limited sub-set of the user's pre-stored information is transmitted to the facing device.

In the illustrative embodiment of the invention, each badge informs a facing badge of the opposite sex of its respective state by transmitting continuously a pulsed RF signal when its transmit control is turned on. (Each type of badge transmits on one frequency and receives on another, so every badge can tell when a facing badge is of the opposite type.) Each pulse has a width of 0.1 millisecond, and the time between pulses depends on whether the probability-enhancement control is on or off. If it is on, there are only 10 milliseconds between successive pulses; if it is off, there are 100 milliseconds between successive pulses. Each badge counts the number of pulses it detects from the other badge during the time it transmits 10 pulses of its own. (Preferably the rates are slightly different due to deliberately poor manufacturing tolerances, so that the two pulse trains are out of sync.) The following table depicts the number of pulses counted by each badge during its counting interval:

| | A transmitter off | A transmitter on A prob.-enh. off | A transmitter on A prob.-enh. on |
|---|---|---|---|
| B transmitter off | A is off, no counting B is off, no counting | A counts 0 B is off, no counting | A counts 0 B is off, no counting |
| B transmitter on B prob.-enh. off | A is off, no counting B counts 0 | A counts 10 B counts 10 | A counts 1 B counts 100 |
| B transmitter on B prob.-enh. on | A is off, no counting B counts 0 | A counts 100 B counts 1 | A counts 10 B counts 10 |

The table shows that each badge, if it is on, counts 0, 1, 10 or 100 pulses. Errors can be tolerated because the only expected counts are 0, 1, 10 or 100. For example, a count of 12 is closer to 10 than it is to 100, so it is treated as a 10. Each badge continues to transmit even when it is done counting. This is so each badge can tell when the facing person has left, and can reset itself so that transmission from another opposite-sex badge can be detected.

Each badge can easily determine from its own state (probability-enhancement button on or off) and its final count whether the other badge is on or off and, if it is on, whether its probability-enhancement button was or was not operated. From the first table above, each badge can thus determine the required blinking probability. But it is still necessary to insure that the two badges, using the same probability figure, agree on whether both lights should blink or not.

A simple way to control this is to have only one badge make the decision (using the already-determined probability and any appropriate random function) and transmit the yes/no answer to the other. In the illustrative embodiment of the invention, the decision is placed in the hands of the girl-badge. After the decision is made, the girl-badge stops transmitting pulses with 10 or 100 milliseconds between pulses, and instead transmits them with gaps of 40 or 70 milliseconds to indicate respectively whether blinking is to be on or off. The boy-badge is thus told whether or not to blink.

It is also possible to make a decision in the boy-badge as well as the girl-badge. (Of course, they must come up with the same decision.) In such a case, the second badge to finish its counting is able to do so because the first badge continues to transmit even though it has finished its counting. Each badge can wait 2 seconds after it has finished counting; this is certainly long enough to insure that the other badge has also finished. Then, each badge can transmit to the other a random number. Using both random numbers and the same probability value that each badge determines based on its count, the two badges can be programmed to come up with the same decision whether or not to match.

In the preferred embodiment where only one badge makes the decision, the girl-badge starts to blink if a decision to "match" has been made, and it transmits with inter-pulse gaps of either 40 or 70 milliseconds to tell the boy-badge whether to blink or not. The boy-badge then continues to transmit at the rate determined by its operated buttons (10-ms or 100-ms inter-pulse intervals), and the girl-badge continues to transmit at the decision-informing rate (inter-pulse intervals of 40 ms or 70 ms), but there is no more decision-making. The badges remain blinking or not based on the initial determination. As soon as a badge ceases to detect contact transmission from an opposite-sex badge, it resets and a new operating cycle begins with the badge looking for contact transmission from another opposite-sex badge. (Similarly, if during the overall operating cycle a person walks away, or covers his badge, or turns off his/her transmitter before a match decision is made, the break in contact transmission causes a reset to occur and the cycle in progress to be aborted.)

In any system equipped for information exchange that affects the probability of contact being made, the exchange occurs immediately before the match decision is made. Any PDA device protocol can be used for this purpose. The information can consist of nothing more than a series of bits, each representing a yes/no answer to a specific question. (Do you want to meet someone more than 25 years old? Do you want to meet only persons who are Catholic? Is common religion a necessity?) The number of bits that match in the vectors of the two persons involved can be used to increase or decrease the probability table value before the decision is made whether or not to match. The question to which each bit is an answer changes from party to party. The questions are typed into and displayed by the badge-issuing machine, and each party-goer answers them. The answers are written into the corresponding badge, and all the badges have to do is to compare bit values.

When either person walks away, both badges reset and are prepared for a new cycle as soon as another person with a badge comes into a facing relationship. Because both badges end up reset whenever one ceases to detect a contact transmission signal, it is possible for any two persons who want to exchange information in their badges to force an exchange. All that has to be done is for one of them to block transmission from his/her badge with a hand. Both badges reset, they immediately detect each other once again, and perhaps this time a "match" will be made. The probability of this happening increases if both persons turn on their probability-enhancement buttons. They can keep on trying until their buttons blink.

It is possible for each badge to have an on/off switch. It is also possible to control contact transmission exclusively from the paired remote control. In the latter case, if contact transmission takes place only if a remote control on/off switch is kept on, there is a way that either person can force another try if a "match" is not made. If he/she turns off his/her transmitter (by operating the out-of-sight remote control transmitter button), both badges will reset. When the button is operated again and the transmitter is turned on, a new cycle will take place. This can be repeated until a match is made. However, it takes several seconds for the lights to blink after two persons first meet (assuming that the match decision is positive). If the lights do not blink until a longer time has gone by, one person will know that the other forced it.

Referring to FIG. 1, a girl-badge 10 is shown. It is the same as a boy-badge except that it transmits on a different frequency (and therefore detects on a different frequency), is run by different software, and the logo 14, with or without an advertisement, is different. The badge includes a light 16 that can blink.

Figure 3:
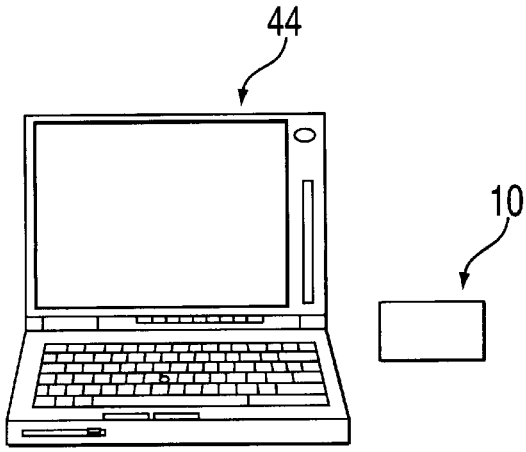
FIG. 3 shows a badge communicating with a personal computer or laptop in order to perform additional functions that will be described.

At the bottom of the badge is a transmitter 20 for transmitting a contact signal to a boy-badge, and a receiver 22 for receiving a contact signal from a boy-badge. Receiver 24 receives the on/off and PE signals from the paired remote control device 12. Remote control device 12 includes a transmitter 26, on/off control button 28 and PE button 30. The only additional element shown in FIG. 1 is IR transmitter/receiver 18 for communicating with a PC or laptop 44 as shown in FIG. 3. A standard IR protocol is employed. As mentioned above, when the girl-badge is first issued, information is stored in by the laptop transmitting to the badge. At the end of the party, information in the badge is downloaded to the laptop so that it can be printed out, and the information in the badge is erased.

The circuitry in the badge is simple. Microprocessor 40 controls all functions, and a memory 42 is provided for storing all data. The microprocessor communicates with all elements shown in FIG. 1 and controls their operations.

Figure 4:
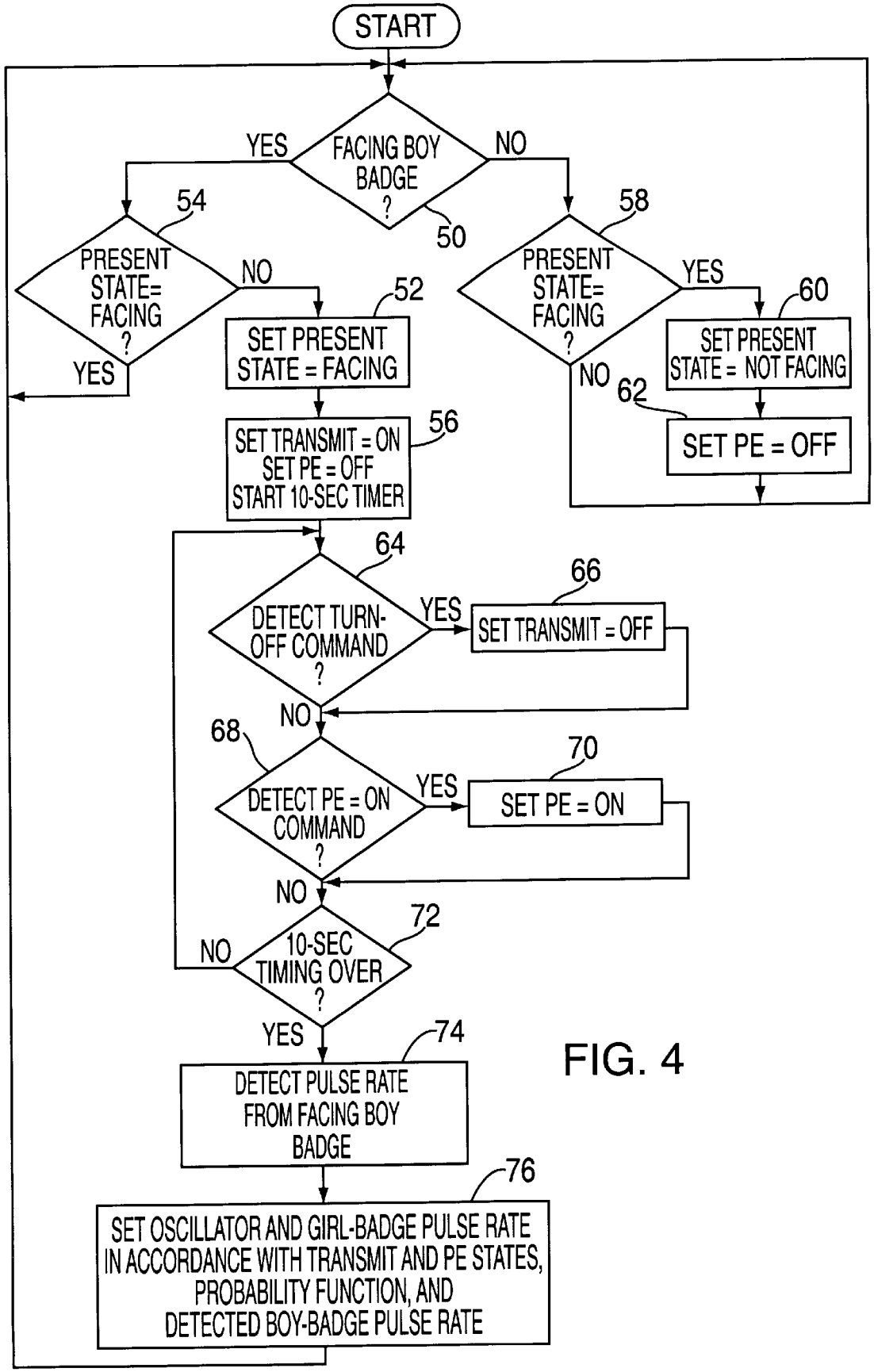
FIG. 4 is a flow chart depicting the basic operation of a girl-badge.

The flow chart depicting operation of girl-badge 10 is shown in FIG. 4. At the start of operation, a test is performed in step 50 to determine if there is a facing boy-badge. The girl-badge maintains a flag that is called "present state" and represents whether there is a facing boy-badge. Yes answers to both questions asked in steps 50 and 54 means that there was a facing boy-badge and it is still there. The system loops back and again asks the same questions. Two no answers also indicate no change, and the cycle repeats. If there is no facing boy-badge but there was on the last loop, the answer to the question in step 58 is yes, and the present-state flag is updated in step 60 to indicate that there is no facing badge (boy). The girl-badge includes a flag in memory that indicates whether the PE button had been operated. In case it had been, the flag is now reset in preparation for another facing boy-badge that may come into range; the default setting for probability enhancement is that it is off. The system then loops back. There is nothing to do until a new boy-badge comes into view. Then the answer to the question in step 50 is yes and the answer to the question step 54 is no. This means that a new boy-badge has just come into range, and it has to be decided whether to effect a "match."

The first thing that is done is to set the present-state flag to "facing" in step 52 so that the answer to the question in step 54 or 58 will be correct in the next loop. There is another flag called "transmit" that tells the badge whether contact transmission is desired by the badge wearer. The default is yes, so the flag is set appropriately in step 56. The default setting for PE is off, so it set off in the same step. Finally, a 10-second timer is started. Ten seconds are allowed for the girl to operate her remote control unit in order to take the badge out of play altogether (to prevent contact) by turning the transmit flag off, or to change the PE flag to on if she would like to meet the new boy. (Obviously both remote buttons should not be operated together—the probability of meeting can not be increased if contact is to be avoided.

In step 64 the system checks whether a turn-off command has been received from the paired remote control device. If it has, the transmit flag is set to off in step 66. In step 68 the system checks whether a PE command has been received from the paired remote control device. If it has, the PE flag is set to on in step 70. In step 72 a check is made whether the 10 second "holding" period has expired. If not, a return is made to step 64. Only if the 10-second time interval has expired does the system advance to step 74.

By now the boy-badge has started to transmit its contact signal to the girl-badge, the inter-pulse interval representing whether contact is to be avoided or, if not, whether the boy has operated his PE button. The table above showing the match probabilities is now consulted. The girl-badge knows its own state as well as that of the boy-badge and, using any standard chance function in accordance with the table, decides in step 76 whether a match is to be effected.

If no match is to made, then in step 76 the contact signal transmitted to the boy-badge is turned off. The girl-badge does not blink, and the boy-badge, when it senses a loss of signal, also does not blink. A return is made to step 50 and nothing happens until the answer to the question is step 58 is yes when the boy and girl separate. (If they talk, the lights still do not blink and the badges do not reset until they part company.) If the girl-badge transmitter is on because she has not turned it off, and the boy-badge transmitter is also on as determined in step 50, then the girl-badge pulse rate (inter-pulse interval of 40 or 70 milliseconds) is determined by the two PE states and the random probability function. Not only is the girl-badge oscillator turned on so her light blinks, but the new pulse rate tells the boy-badge whether it should blink.

Figure 5:
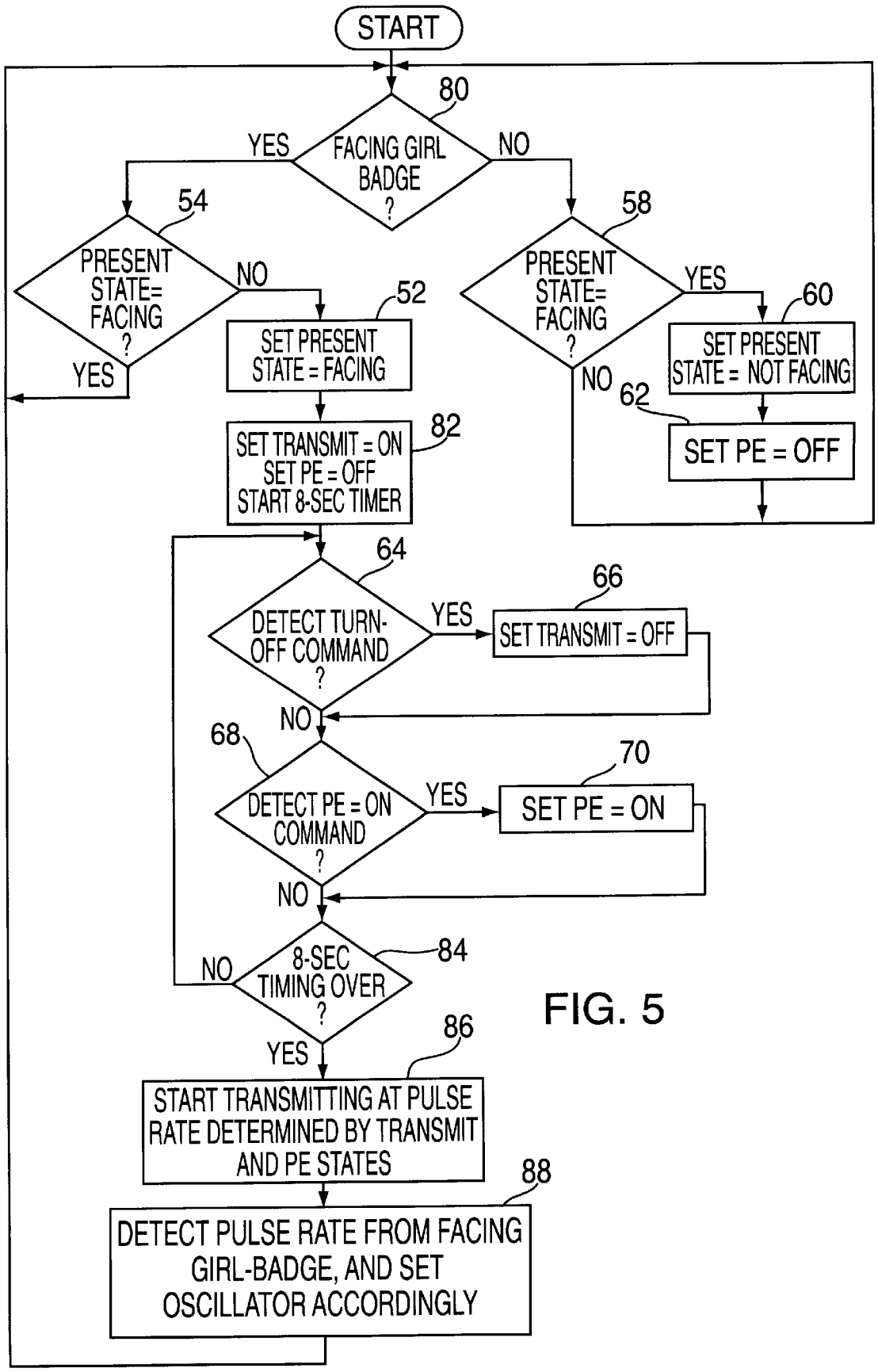
FIG. 5 is a flow chart depicting the basic operation of a boy-badge.

The operation in the boy-badge is very similar, and the steps in FIG. 5 that are the same as those in FIG. 4 have the same reference numerals. Of course, in respective steps 50 and 80 transmission is received on different frequencies as described above. In step 82, an 8-second timer is started rather than a 10-second timer. This is to ensure that the boy-badge transmits with the appropriate inter-pulse interval before the girl-badge makes the decision whether a match should be made. Otherwise, the processing is basically the same until step 86 is reached. Here, the boy-badge transmits its contact signal with an inter-pulse interval that represents the states of its transmit and PE flags so that the girl-badge can make its decision. After the girl-badge makes the decision and changes its inter-pulse interval, the boy-badge detects the inter-pulse interval in step 88 and sets its oscillator on if its light is to blink. The processing then starts all over again with step 80 at the top of the flow chart.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What I claim is:

1. A method of facilitating contact between members of two different groups of persons comprising the steps of:

(a) assigning two groups of devices to respective members of the two groups of persons, each device in each group being capable of communicating with any device in the other group when the two devices are in proximity to each other, (b) for two devices in different groups that are in proximity to each other, making a decision that is at least partly random whether the two persons to whom those devices are assigned should make contact, the decision being at least partly random in the sense that any repeated set of conditions can give rise to different decisions, and (c) in accordance with said decision, controlling at least one of the two devices to provide an indication whether said two persons should make contact.

2. A method of facilitating contact in accordance with claim 1 wherein either of said two persons can control the respective assigned device to preclude the making of a decision that said two persons should make contact.

3. A method of facilitating contact in accordance with claim 2 wherein, in the absence of both of said two persons precluding the making of a decision that said two persons should make contact, either of said two persons can control the respective assigned device to increase the likelihood of a decision that said two persons should make contact.

4. A method of facilitating contact in accordance with claim 1 wherein either of said two persons can control the respective assigned device to increase the likelihood of a decision that said two persons should make contact.

5. A method of facilitating contact in accordance with claim 1 wherein each of said devices stores personal information about the person to whom it is assigned, and the likelihood of a decision that said two persons should make contact is increased if the personal information stored in the two assigned devices indicates that the persons are compatible with each other.

6. A method of facilitating contact in accordance with claim 5 wherein the personal information stored in a device about the person to whom the device is assigned can be changed and new personal information is stored in the device when it is assigned to a new person.

7. A method of facilitating contact in accordance with claim 1 wherein each of said devices includes personal information about the person to whom it is assigned, and if a decision is made that said two persons should make contact then certain of said personal information is exchanged between the two assigned devices.

8. A method of facilitating contact in accordance with claim 7 wherein the personal information stored in a device about the person to whom the device is assigned can be changed and new personal information is stored in the device when it is assigned to a new person.

9. A method of facilitating contact in accordance with claim 7 wherein personal information in any of said devices stored as a result of an exchange is retrieved and given to the person to whom said device is assigned.

10. A method of facilitating contact in accordance with claim 9 wherein the personal information in any of said devices that is exchanged is determined by the person to whom said device is assigned.

11. A method of facilitating contact in accordance with claim 1 wherein each of said devices is reset to communicate with another device in response to a device with which it is presently communicating moving out of proximity.

12. A system for matching members of two different groups of persons comprising:

(a) two groups of devices assignable to respective members of the two groups of persons, each device in each group being capable of communicating with any device in the other group when the two devices are in proximity to each other, (b) a decision-making module in each device of at least one group that decides, at least partly in a random manner, whether two persons in proximity to each other and to whom devices in the different groups are assigned should be matched, the decision being at least partly in a random manner in the sense that any repeated set of conditions can give rise to different decisions, and (c) an indicator on at least one of the two devices to provide an indication whether said two persons have been matched.

13. A system for matching members of two different groups of persons in accordance with claim 12 wherein each of said devices includes a control that precludes the making of a decision that said two persons in proximity to each other should be matched.

14. A system for matching members of two different groups of persons in accordance with claim 13 wherein each of said devices includes a control that can increase the likelihood of a decision that said two persons in proximity to each other should be matched in the absence of both of said persons precluding the making of a decision that they should be matched.

15. A system for matching members of two different groups of persons in accordance with claim 12 wherein each of said devices includes a control that can increase the likelihood of a decision that said two persons in proximity to each other should be matched.

16. A system for matching members of two different groups of persons in accordance with claim 12 wherein each of said devices stores personal information about the person to whom it is assigned, and the likelihood of a decision that said two persons in proximity to each other should be matched is increased if the personal information stored in the two respective devices indicates that the persons are compatible with each other.

17. A system for matching members of two different groups of persons in accordance with claim 16 wherein each of said devices allows the personal information stored in it to be changed.

18. A system for matching members of two different groups of persons in accordance with claim 12 wherein each of said devices stores personal information about the person to whom it is assigned, and exchanges such information with the device assigned to a person in proximity if a decision is made that said two persons should be matched.

19. A system for matching members of two different groups of persons in accordance with claim 18 wherein each of said devices allows the personal information stored in it to be changed.

20. A system for matching members of two different groups of persons in accordance with claim 18 wherein personal information in any of said devices stored as a result of an exchange is retrieved and given to the person to whom the device is assigned.

21. A system for matching members of two different groups of persons in accordance with claim 20 wherein the personal information in any of said devices that is exchanged is selectable by the person to whom said device is assigned.

22. A system for matching members of two different groups of persons in accordance with claim 12 wherein each of said devices is reset to communicate with another device in response to a device with which it is presently communicating moving out of proximity.

* * * * *